US008595980B1

(12) United States Patent
Hsu

(10) Patent No.: US 8,595,980 B1
(45) Date of Patent: Dec. 3, 2013

(54) DOOR COORDINATOR

(71) Applicant: Wei-Chung Hsu, Tainan (TW)

(72) Inventor: Wei-Chung Hsu, Tainan (TW)

(73) Assignee: I-Tek Metal Mfg. Co., Ltd., Tainan (TW)

( * ) Notice: Subject to any disclaimer, the term of this patent is extended or adjusted under 35 U.S.C. 154(b) by 0 days.

(21) Appl. No.: 13/783,439

(22) Filed: Mar. 4, 2013

(51) Int. Cl.
*E05F 5/12* (2006.01)

(52) U.S. Cl.
USPC ..... 49/366

(58) Field of Classification Search
USPC ..... 49/103, 116, 366, 367, 73.1
See application file for complete search history.

(56) References Cited

U.S. PATENT DOCUMENTS

| | | | | |
|---|---|---|---|---|
| 1,796,050 | A * | 3/1931 | Rosenberg | 16/82 |
| 3,894,356 | A * | 7/1975 | Imhoff | 49/366 |
| RE29,107 | E | 1/1977 | Imhoff | 49/366 |
| 5,199,216 | A * | 4/1993 | Vetter et al. | 49/109 |
| 5,944,399 | A * | 8/1999 | Gillispie | 312/324 |
| 6,401,393 | B2 * | 6/2002 | Juntunen | 49/367 |

* cited by examiner

*Primary Examiner* — Katherine Mitchell
*Assistant Examiner* — Justin Rephann
(74) *Attorney, Agent, or Firm* — Alan Kamrath; Kamrath IP Lawfirm, P.A.

(57) ABSTRACT

A door coordinator includes a base fixed to a mounting face of a door frame to which inactive and active doors are pivotably mounted. A pivotal member includes an axle pivotably mounted to the base. A first arm extends from an end of the axle. A shorter second arm is formed on the other end of the axle. A buffering wheel and a guiding wheel are rotatably mounted to the first and second arms, respectively. A pressing bolt is threadedly engaged in a screw hole in a rear end of the second arm. The pressing bolt is rotatable relative to the second arm to adjust a length of an exposed section of the pressing bolt outside of the screw hole, such that a height of each of the buffering wheel and the guiding wheel in a vertical direction relative to a longitudinal axis of the axle can be adjusted.

3 Claims, 12 Drawing Sheets

DOOR COORDINATOR

BACKGROUND OF THE INVENTION

The present invention relates to a door coordinator and, more particularly, to a door coordinator for controlling sequential closing of a pair of swinging doors including an active door and an inactive door.

A pair of swinging doors is usually used in a building and includes an active door and an inactive door. The active door includes a shield on an edge facing the inactive door to prevent wind and sand from entering the indoor space via a gap between the active and inactive doors. A door coordinator is generally used to hold the active door open until the inactive door reaches a closing position. A type of the door coordinator includes a pivotal member having a first arm at the active door side and a second arm at the inactive door side. The second arm is shorter than the first arm. A roller made of soft material is rotatably mounted to a distal end of the first arm. When the inactive door is not in the closing position, the roller is below a top side of the active door in a vertical direction perpendicular to the ground. Pivotal movement of the active door from a non-closing position to a closing position will be stopped by the roller if the inactive door is not in its closing position. If the active door and the inactive door are pivoted to their closing positions at the same time, the inactive door presses against the second arm and causes upward movement of the roller along the active door. The active door can be pivoted to its closing position after the roller reaches a position above the top side of the active door.

However, the roller deforms after repeated impact and pressing by the active door, resulting in an uneven outer periphery. Thus, the roller can not smoothly roll along the active door to the position above the top side of the active door, and both of the active and inactive doors can not reach their closing positions.

To allow adjustment in the height of the roller in the vertical direction, a screw is used to press against the pivotal member. By rotating the screw, the pivotal member pivots through a small angle to change the height of a distal end of the second arm relative to the top side of the inactive door. However, the screw causes wear to and generates cavities in a surface of the door coordinator, reducing the height of the distal end of the second arm, such that the inactive door can not pivot to its closing position. As a result, both of the active and inactive doors can not pivot to their closing positions. Furthermore, the screw is generally mounted to a base of the door coordinator and located in a gap between the base and the pivotal member, which does not allow easy rotation of the screw.

Thus, a need exists for a durable and easy-to-adjust door coordinator.

BRIEF SUMMARY OF THE INVENTION

The present invention solves this need and other problems in the field of durable and adjustable door coordinators for a pair of swinging doors by providing a door coordinator including a base having an outer face. An insertion groove is formed in the outer face of the base. The base is adapted to be fixed to a mounting face of a door frame. An inactive door and an active door are adapted to be pivotably mounted to the door frame. Each of the inactive door and the active door is adapted to be pivotable between a closing position and a non-closing position. An abrasion resistant member is fixed in the insertion groove. A pivotal member includes an axle pivotably mounted to the base. The axle includes first and second ends spaced from each other along a longitudinal axis of the axle perpendicular to a vertical direction. A first arm extends from the first end of the axle in a radial direction perpendicular to the longitudinal axis of the axle and has a distal end. A second arm is formed on the second end of the axle and has a length in the radial direction smaller than a length of the first arm in the radial direction. The second arm includes front and rear ends. The front end of the second arm is located between the axle and the distal end of the first arm. A screw hole is formed in the rear end of the second arm. The pivotal member is pivotable relative to the base between a blocking position and a non-blocking position.

The door coordinator further includes a guiding wheel rotatably mounted to the second arm. When the pivotal member is in the blocking position, the guiding wheel is adapted to press against by a top side of the inactive door. The top side of the inactive door actuates the guiding wheel when the inactive door is moving from the non-closing position to the closing position, causing pivotal movement of the pivotal member from the blocking position to the non-blocking position.

The door coordinator further includes a buffering wheel rotatably mounted to the distal end of the first arm. When the pivotal member is in the blocking position, the buffering wheel is adapted to block the active door to prevent the active door from moving from the non-closing position to the closing position. When the pivotal member is in the non-blocking position, the buffering wheel is located above a top surface of the active door, allowing the active door to pivot from the non-closing position to the closing position.

The door coordinator further includes a pressing bolt threadedly and rotatably engaged in the screw hole in the second arm. The pressing bolt includes an inner end received in the screw hole and an outer end outside of the screw hole. The outer end of the pressing blot presses against the abrasion resistant member when the pivotal member is in the blocking position. The outer end of the pressing blot is spaced from the abrasion resistant member when the pivotal member is in the non-blocking position. The pressing bolt is rotatable relative to the second arm to adjust a length of an exposed section of the pressing bolt outside of the screw hole.

When the pivotal member is in the blocking position, a height of each of the buffering wheel and the guiding wheel in the vertical direction relative to longitudinal axis of the axle is increased if the length of the exposed section of the pressing bolt is increased, and the height of each of the buffering wheel and the guiding wheel in the vertical direction relative to the longitudinal axis is decreased if the length of the exposed section of the pressing bolt is decreased.

The present invention will become clearer in light of the following detailed description of illustrative embodiments of this invention described in connection with the drawings.

DESCRIPTION OF THE DRAWINGS

The illustrative embodiments may best be described by reference to the accompanying drawings where.

Figure 1:
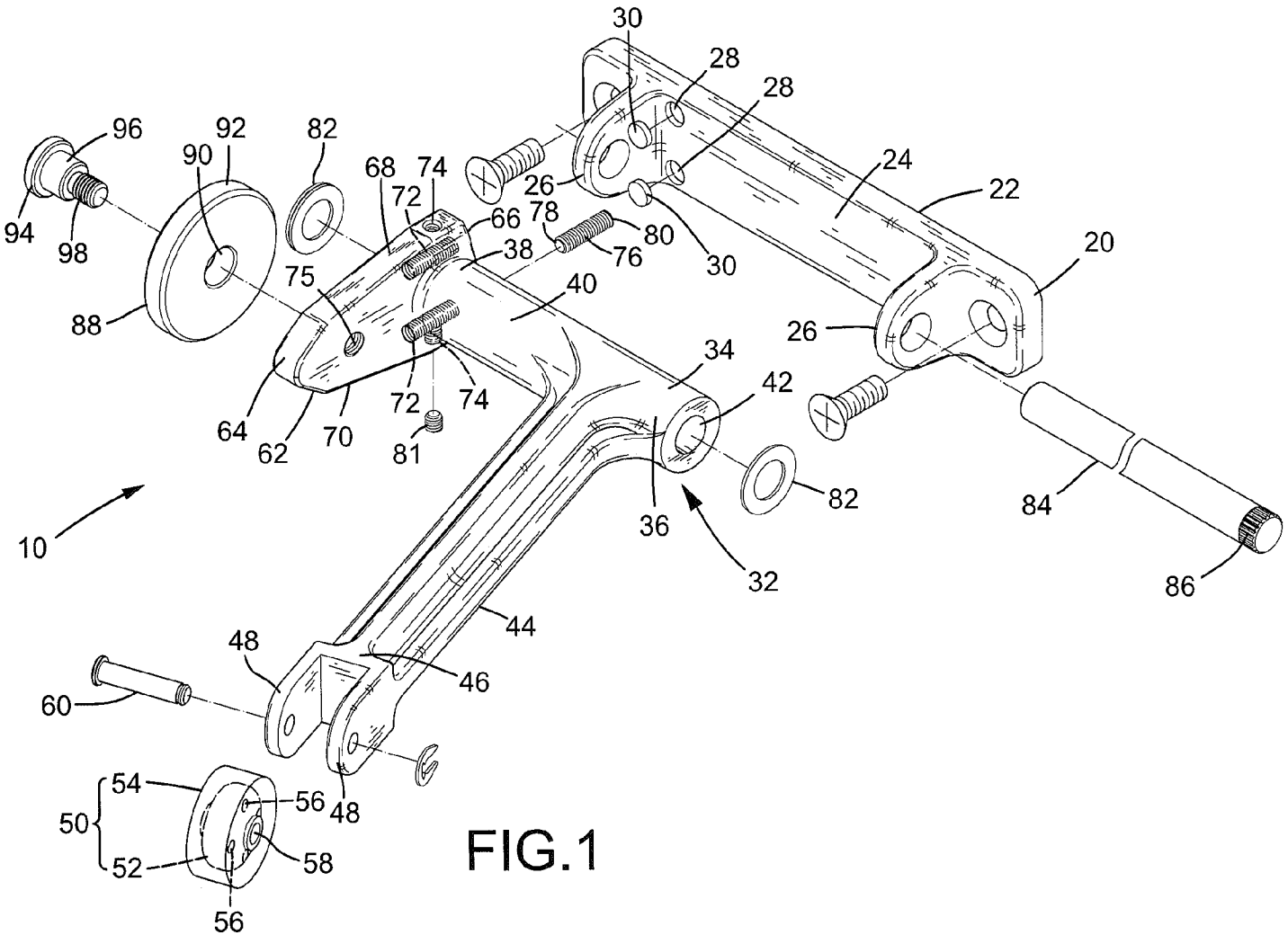
FIG. 1 shows an exploded, perspective view of a door coordinator according to the present invention.
Figure 2:
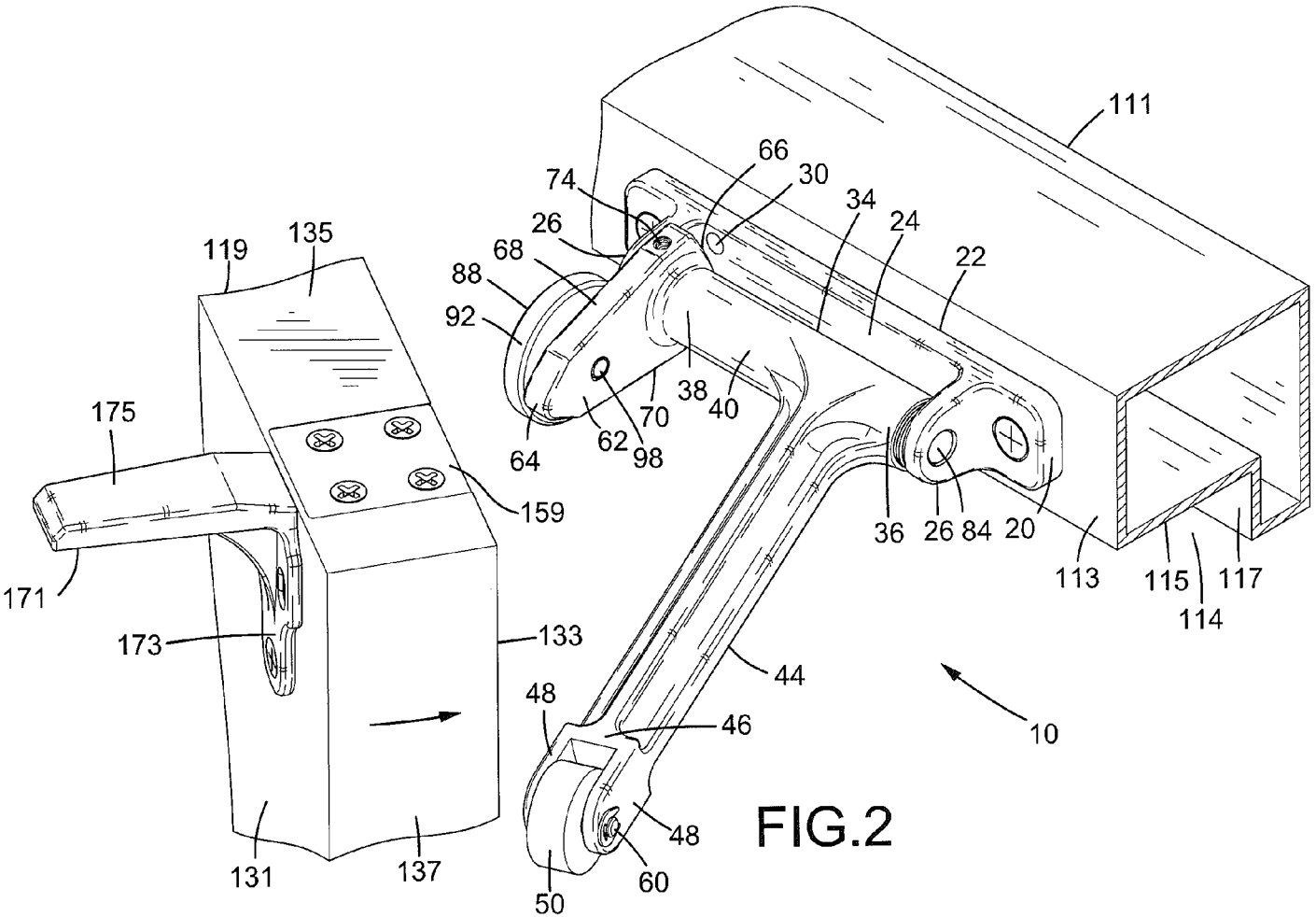
FIG. 2 shows a perspective view of the door coordinator of FIG. 1 and a portion of a pair of swinging doors including an active door and an inactive door.

All figures are drawn for ease of explanation of the basic teachings of the present invention only; the extensions of the figures with respect to number, position, relationship, and dimensions of the parts to form the embodiments will be explained or will be within the skill of the art after the following teachings of the present invention have been read and understood. Further, the exact dimensions and dimensional proportions to conform to specific force, weight, strength, and similar requirements will likewise be within the skill of the art after the following teachings of the present invention have been read and understood.

Where used in the various figures of the drawings, the same numerals designate the same or similar parts. Furthermore, when the terms "first", "second", "lower", "upper", "top", "bottom", "inner", "outer", "side", "end", "portion", "section", "longitudinal", "lateral", "horizontal", "vertical", "radial", "length", "width", "height", and similar terms are used herein, it should be understood that these terms have reference only to the structure shown in the drawings as it would appear to a person viewing the drawings and are utilized only to facilitate describing the invention.

DETAILED DESCRIPTION OF THE INVENTION

A door coordinator according to the present invention is shown in the drawings and generally designated 10. Door coordinator 10 is mounted to a door frame 111 in a passageway and having substantially L-shaped cross sections. Door frame 111 includes a top section having a mounting face 113 extending in a vertical direction perpendicular to the ground. Door frame 111 further includes a recess 114 in a bottom side thereof. Recess 114 includes a horizontal face 115 perpendicular to mounting face 113 and a vertical face 117 perpendicular to horizontal face 115 and parallel to and spaced from mounting face 113. A pair of swinging doors is mounted to door frame 111 and includes an inactive door 119 pivotably mounted to a side of door frame 111 and an active door 139 pivotably mounted to the other side of door frame 111. The top section of door frame 111 extends between upper ends of the sides of door frame 111. Inactive door 119 includes a first side 131 and a second side 133 opposite to first side 131 and facing vertical face 117 of door frame 111. Inactive door 119 further includes a top side 135 extending between first and second sides 131 and 133. Inactive door 119 further includes a lateral side 137 extending between first and second sides 131 and 133 and extending in the vertical direction perpendicular to top side 135. Active door 139 includes a first surface 151 and a second surface 153 opposite to first surface 151 and facing vertical face 117 of door frame 111. Active door 139 further includes a top surface 154 extending between first and second surfaces 151 and 153. Active door 139 further includes a lateral surface 155 extending between first and second surfaces 151 and 153 and extending in the vertical direction perpendicular to top surface 154. A shield 157 is fixed to an edge of first surface 151 and extends beyond lateral surface 155. A first door closer 177 is mounted to first side 131 of inactive door 119. A second door closer 177 is mounted to first surface 151 of active door 139.

A pad 159 is mounted to inactive door 119. In the form shown, pad 159 is substantially L-shaped and includes a horizontal portion embedded in top side 135 of inactive door 119 and a vertical section embedded in second side 133 of inactive door 119. A support 171 includes an engagement portion 173 fixed to first side 131 of inactive door 119 and a supporting portion 175 extending from an upper end of engagement portion 173 and aligned with the horizontal portion of pad 159.

Figure 3:
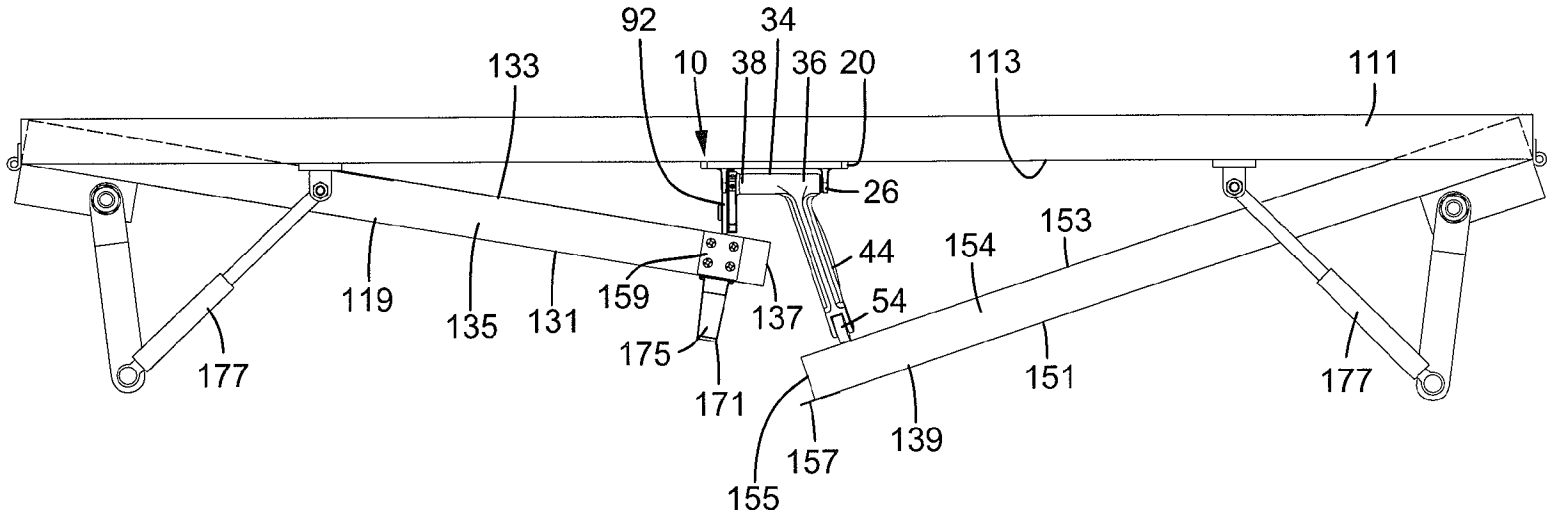
FIG. 3 shows a top view of the swinging doors and the door coordinator of FIG. 2.

Each of inactive door 119 and active door 139 is pivotable between a non-closing position (FIGS. 3 and 4) outside of recess 114 of door frame 111 and a closing position (FIG. 10) in recess 114. First and second door closers 177 are used to retain inactive door 119 and active door 139 in the non-closing position. When inactive and active doors 119 and 139 are pivoted from the non-closing positions to the closing positions, first and second door closers 177 push inactive and active doors 119 and 139 to the closing positions.

Door coordinator 10 according to the present invention includes a base 20 having substantially rectangular cross sections. Base 20 includes an inner face 22 and an outer face 24 opposite to inner face 22. Two lugs 26 are formed on outer face 24. Two insertion grooves 28 are formed in outer face 24 and located between lugs 26 and adjacent to one of lugs 26. Inner face 22 of base 20 abuts mounting face 113 of door frame 111. Screws are extended through base 20 into mounting face 113 to fix base 20 to door frame 111. An abrasion resistant member 30 is mounted in each insertion groove 28.

According to the form shown, door coordinator 10 further includes a pivotal member 32 pivotably mounted to base 20 and includes an axle 34 having first and second ends 36 and 38 spaced from each other along a longitudinal axis of axle 34. An axle hole 42 extends from first end 36 through second end 38 of axle 34. Axle 34 further includes an outer periphery 40 extending between first and second ends 36 and 38. A first arm 44 extends from outer periphery 40 at first end 36 in a radial direction perpendicular to the longitudinal axis of the axle. Two ears 48 are formed on a distal end 46 of first arm 44 away from axle 34.

According to the form shown, a second arm 62 extends from outer periphery 40 at second end 38 and has a length in the radial direction smaller than a length of first arm 44 in the radial direction. Second arm 62 includes front and rear ends 64 and 66 and top and bottom faces 68 and 70 extending between front and rear ends 64 and 66. Second arm 62 includes a positioning screw hole 75 between front end 64 and axle 34 and parallel to and spaced from axle hole 42. Upper and lower screw holes 72 are formed in rear end 66 of second arm 62 and respectively adjacent to top and bottom faces 68 and 70. A top screw hole 74 is formed in top face 68 of second arm 62 and in communication with upper screw hole 72. A bottom screw hole 74 is formed in bottom face 70 of second arm 62 and in communication with lower screw hole 72.

Figure 7:
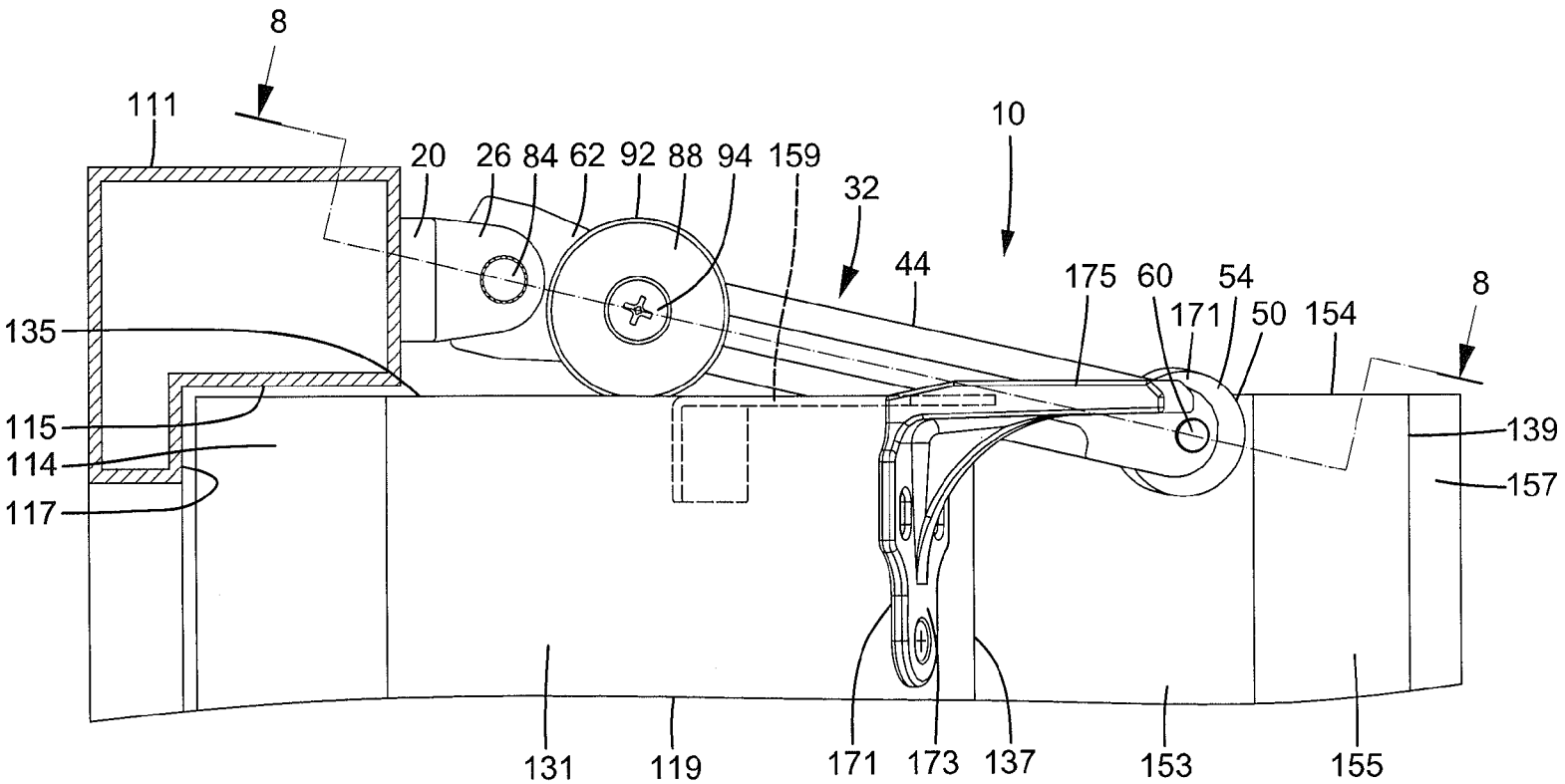
FIG. 7 is a view showing a position of a buffering wheel below a top side of the active door while a pivotal member of the door coordinator is in a blocking position.
Figure 8:
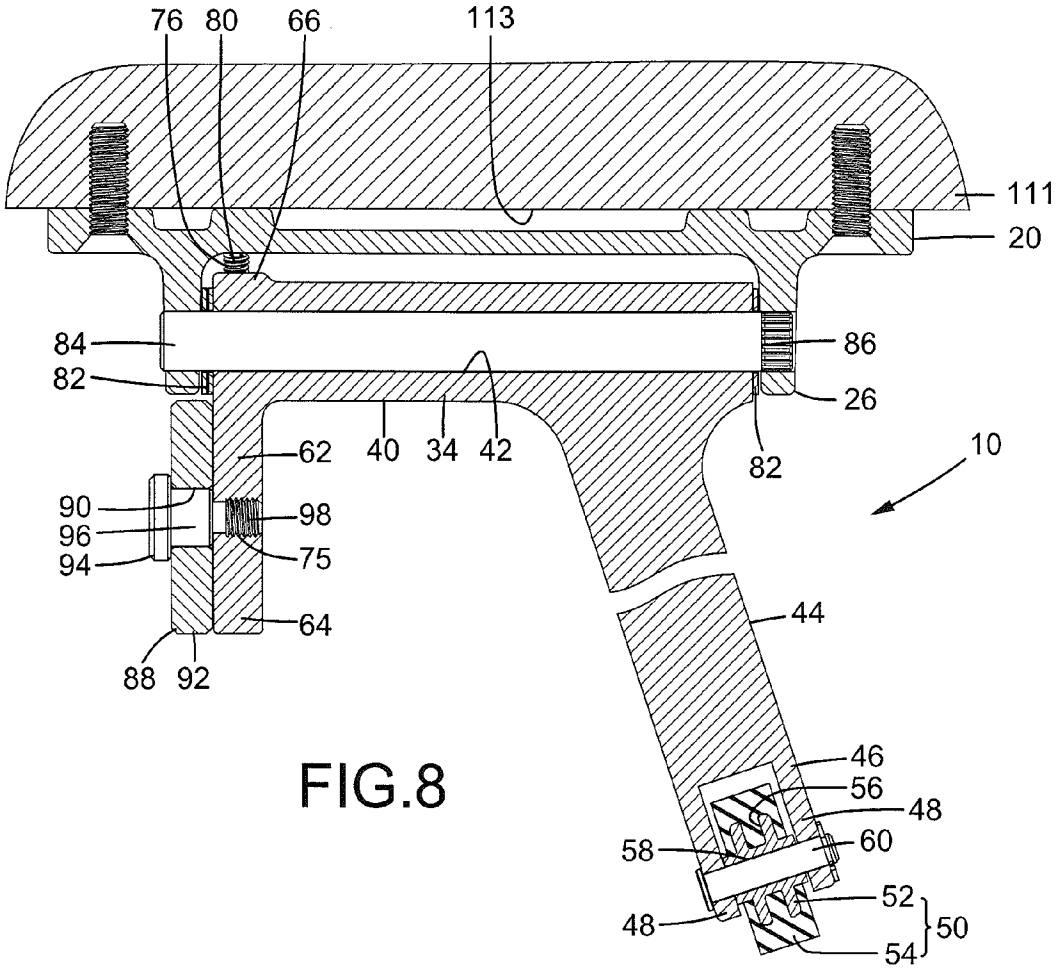
FIG. 8 is a cross sectional view taken along section line 8-8 of FIG. 7.
Figure 9:
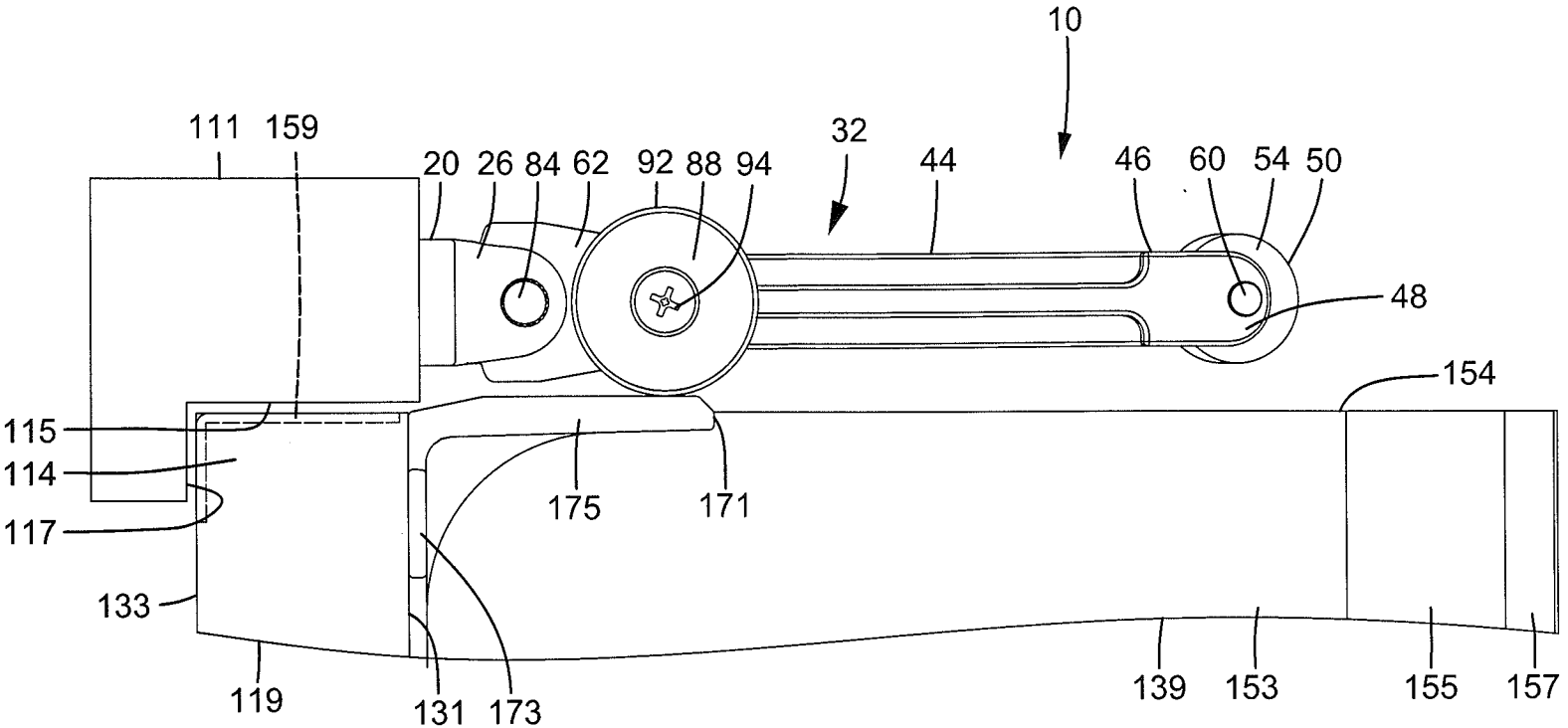
FIG. 9 is a view similar to FIG. 7, with the inactive door in a closing position, with the pivotal member in a non-blocking position, with the buffering wheel in a location above the top side of the active door.

Axle 34 of pivotal member 32 is received between lugs 26 of base 20. A washer 82 is mounted between first end 36 of axle 34 and one of lugs 26 facing first end 36. Another washer 82 is mounted between second end 38 of axle 34 and the other lug 26. A shaft 84 is extended through lugs 26, washers 82, and axle hole 42 and has an embossed pressing end 86 tightly received in one of lugs 26 (FIG. 8). Thus, pivotal member 32 is pivotable relative to base 20 between a blocking position (FIGS. 6 and 7) and a non-blocking position (FIG. 9). First arm 44 faces second surface 153 of active door 139. Second arm 62 faces second side 133 of inactive door 119.

According to the form shown, door coordinator 10 further includes a buffering wheel 50 having a rigid portion 52 in the form of a roller. Rigid portion 52 includes a pivotal portion 58. A plurality of engagement holes 56 is formed in two sides of rigid portion 52. A soft portion 54 envelopes rigid portion 52 and is made of a material such as rubber. The material of soft portion 54 fills engagement holes 56 such that soft portion 54 is integrally formed with rigid portion 52 as a single member. Buffering wheel 50 is received between ears 48 on first arm 44. A pin 60 extends through ears 48 and pivotal portion 58 of buffering wheel 50, allowing buffering wheel 50 to rotate about a rotating axis defined by pin 60. Buffering wheel 50 and pivotal member 32 pivot jointly between the blocking position and the non-blocking position.

Figure 6:
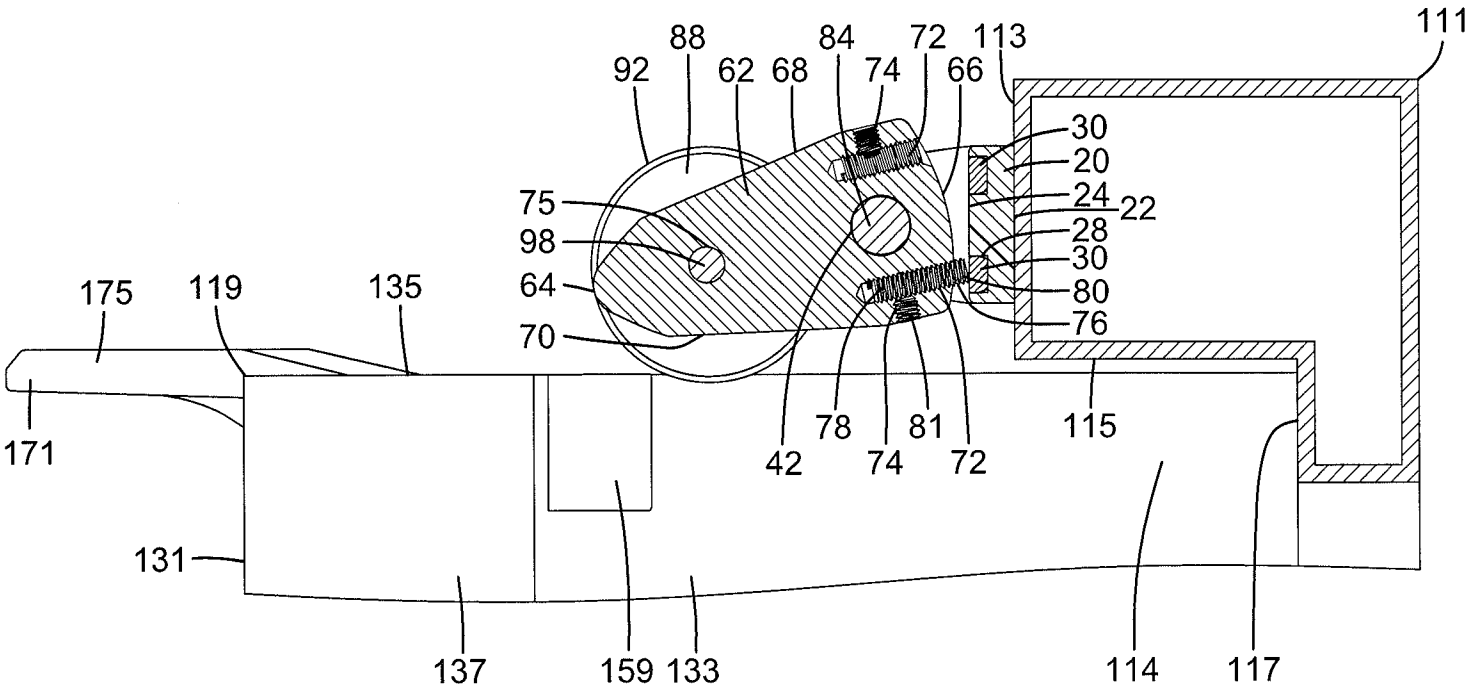
FIG. 6 is a cross sectional view taken along section line 6-6 of FIG. 4.

According to the form shown, door coordinator 10 further includes a guiding wheel 88 having an outer periphery 92 and an axial hole 90 in a central portion thereof. A pivot 94 includes a pivotal section 96 and a locking section 98 having an outer thread. Pivot 94 extends through guiding wheel 88 axial hole 90 of, with pivotal section 96 received in axial hole 90 of guiding wheel 88, and with guiding wheel 88 rotatable about pivot 94. Locking section 98 is engaged with positioning screw hole 75 of second arm 62 of pivotal member 32. Thus, guiding wheel 88 is rotatably mounted to a side of second arm 62. Top and bottom faces 68 and 70 of second arm 62 are located between the highest point and the lowest point of outer periphery 92 of guiding wheel 88 in the vertical direction (FIG. 6). Guiding wheel 88 moves jointly with pivotal member 32 between the blocking position and the non-blocking position. Buffering wheel 50 in the blocking position is lower than buffering wheel 50 in the non-blocking position in the vertical direction. Guiding wheel 88 in the blocking position is lower than guiding wheel 88 in the non-blocking position in the vertical direction.

According to the form shown, door coordinator 10 further includes a pressing bolt 76 having inner and outer ends 78 and 80. Pressing bolt 76 has an outer thread extending from inner end 78 through outer end 80. Inner end 78 of pressing bolt 76 is mounted in lower screw hole 72 of second arm 62 (FIG. 6). Outer end 80 of pressing bolt 76 is located outside of lower screw hole 72. A length of an exposed section of pressing bolt 76 outside of lower screw hole 72 can be adjusted by rotating pressing bolt 76. A bolt 81 is mounted in bottom screw hole 74 of second arm 62 and has an end pressing against an outer periphery of pressing bolt 76 for retaining pressing bolt 76 after adjustment. When pivotal member 32 is in the blocking position, outer end 80 of pressing bolt 76 abuts against one of abrasion resistant member 30 in one of insertion grooves 28 of base 20 (FIG. 6). When pivotal member 32 is in the non-blocking position, outer end 80 of pressing block 76 is spaced from abrasion resistant members 30.

Now that the basic construction of door coordinator 10 has been explained, the operation and some of the advantages of door coordinator 10 can be set forth and appreciated. In particular, for the sake of explanation, it will be assumed that inactive door 119 and active door 139 are in the non-closing positions (FIGS. 3 and 4), and outer end 80 of pressing bolt 76 abuts against one of abrasion resistant members 30. In this state, top side 135 of inactive door 119 is located between pivot 94 and a bottommost point of outer periphery 92 of guiding wheel 88 (FIG. 6). Top surface 154 of active door 139 is located above pin 60 in the vertical direction.

Figure 4:
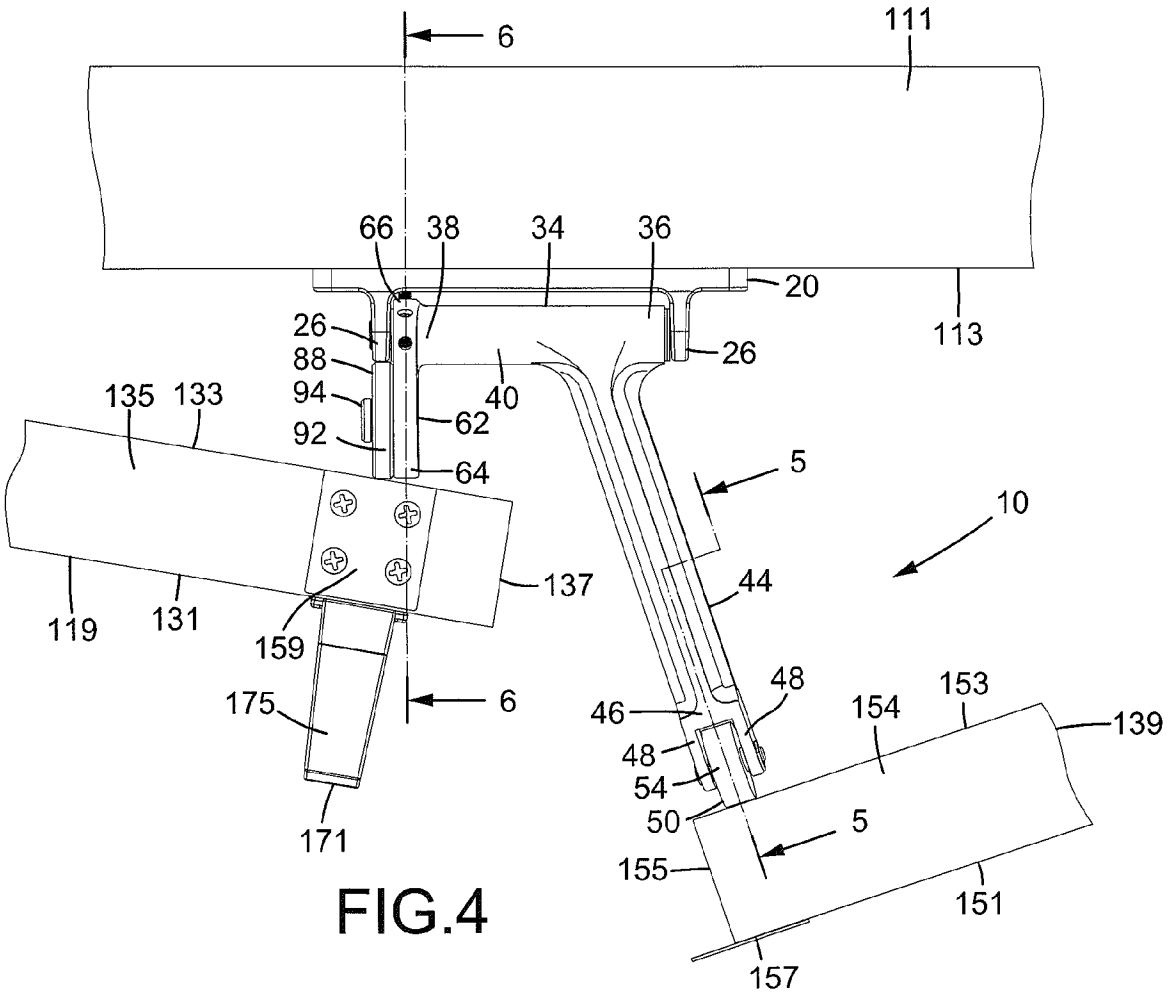
FIG. 4 shows an enlarged view of a portion of the swinging doors and the door coordinator of FIG. 3.
Figure 5:
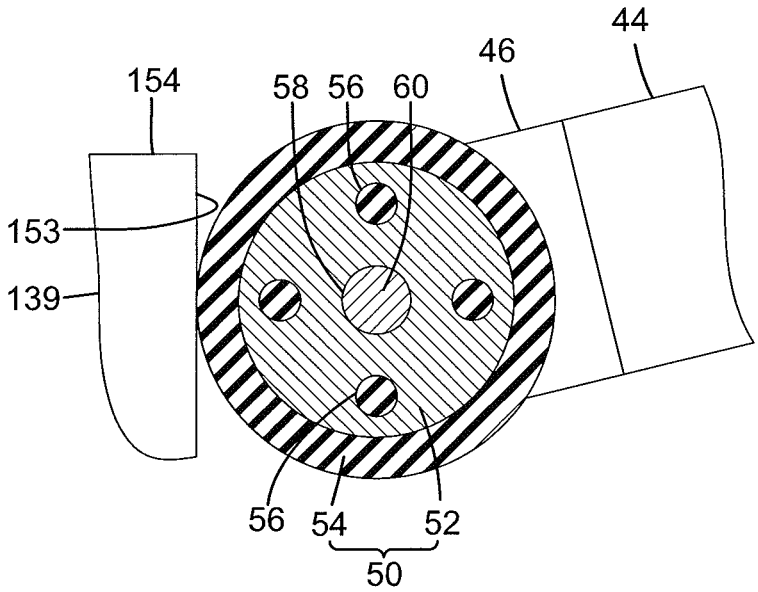
FIG. 5 is a cross sectional view taken along section line 5-5 of FIG. 4.

When both of inactive door 119 and active door 139 are simultaneously pivoted from the non-closing positions to the closing positions, first and second door closers 177 assist in pivotal movement of inactive door 119 and active door 139 to the closing positions. Since first arm 44 is longer than second arm 62, second surface 153 of active door 139 presses against and is, thus, stopped by buffering wheel 50 (FIGS. 4 and 7). Thus, the second door closer 177 can not further pivot active door 139 to the closing position. At the same time, the first door closer 177 keeps pivoting inactive door 119 to the closing position. When pad 159 on inactive door 119 comes in contact with guiding wheel 88 of door coordinator 10 (FIGS. 6 and 7), the first door closer 177 continues to pivot inactive door 119 to the closing position. Guiding wheel 88 is pressed against by pad 159 and rolls, pivoting pivotal member 32 from the blocking position (FIG. 7) to the non-blocking position (FIG. 9) while buffering wheel 50 is rolling on second surface 153 of active door 139.

Figure 10:
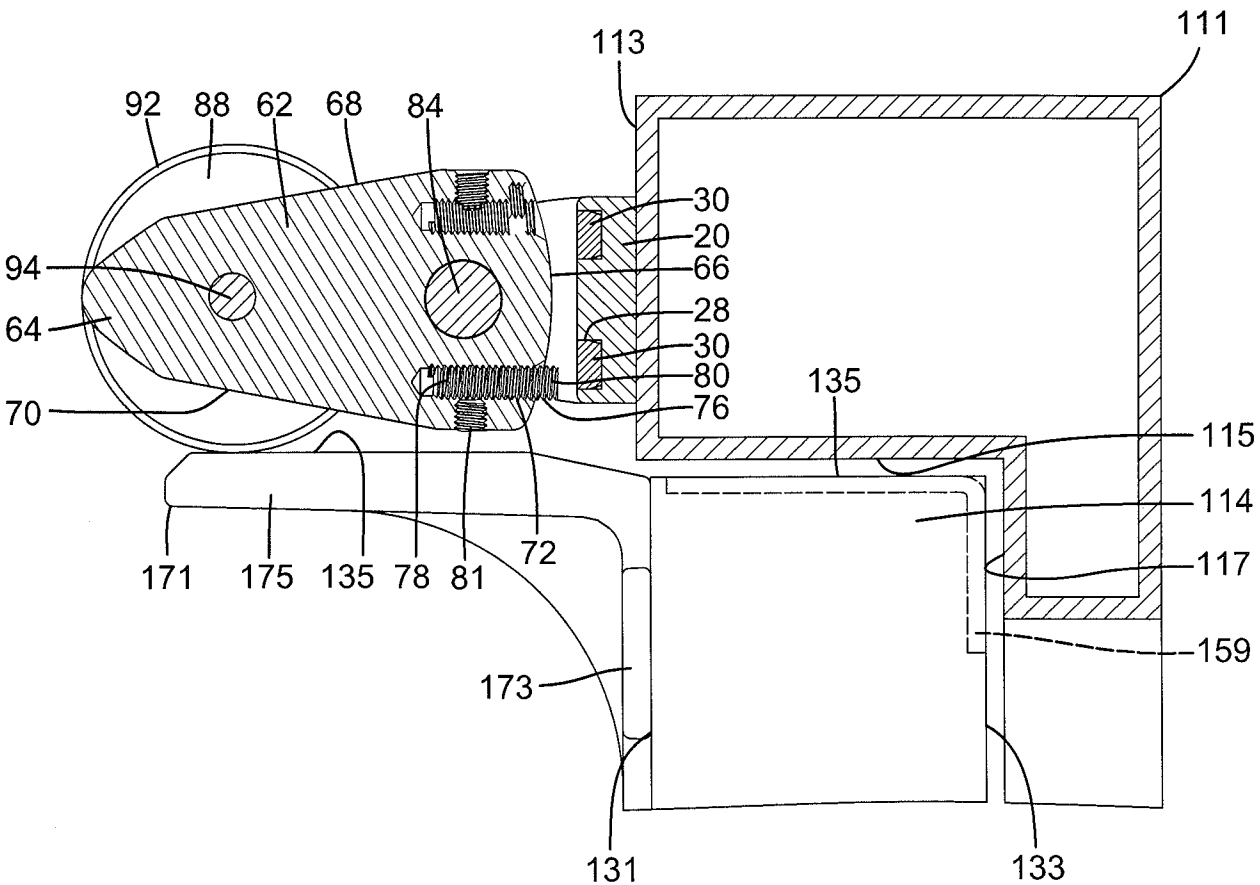
FIG. 10 is a view similar to FIG. 6, with the pivotal member in the non-blocking position, with an outer end of a pressing bolt spaced from an abrasion resistant member.

After inactive door 119 reaches its closing position, supporting portion 175 of support 171 supports guiding wheel 88 and retains pivotal member 32 in the non-blocking position (FIGS. 9 and 10). Buffering wheel 50 moves in the vertical direction to a position above top surface 154 of active door 139 (FIG. 9) and, thus, no longer blocks active door 139. In this state, second door closer 177 pivots active door 139 to its closing position. After active door 139 reaches its closing position, shield 157 on active door 139 abuts first side 131 of inactive door 119. With active door 139 in the closing position, inactive door 119 can not be moved from its closing position to its non-closing position.

When it is desired to open inactive door 119 and active door 139, active door 139 is firstly pivoted from its closing position to its non-closing position, and shield 157 is moved away from inactive door 119 to allow movement of inactive door 119 from its closing position to its non-closing position. When both of inactive door 119 and active door 139 are in the non-closing positions, pivotal member 32 pivots from the non-blocking position (FIG. 9) to the blocking position under the action of the gravitational force.

Figure 11:
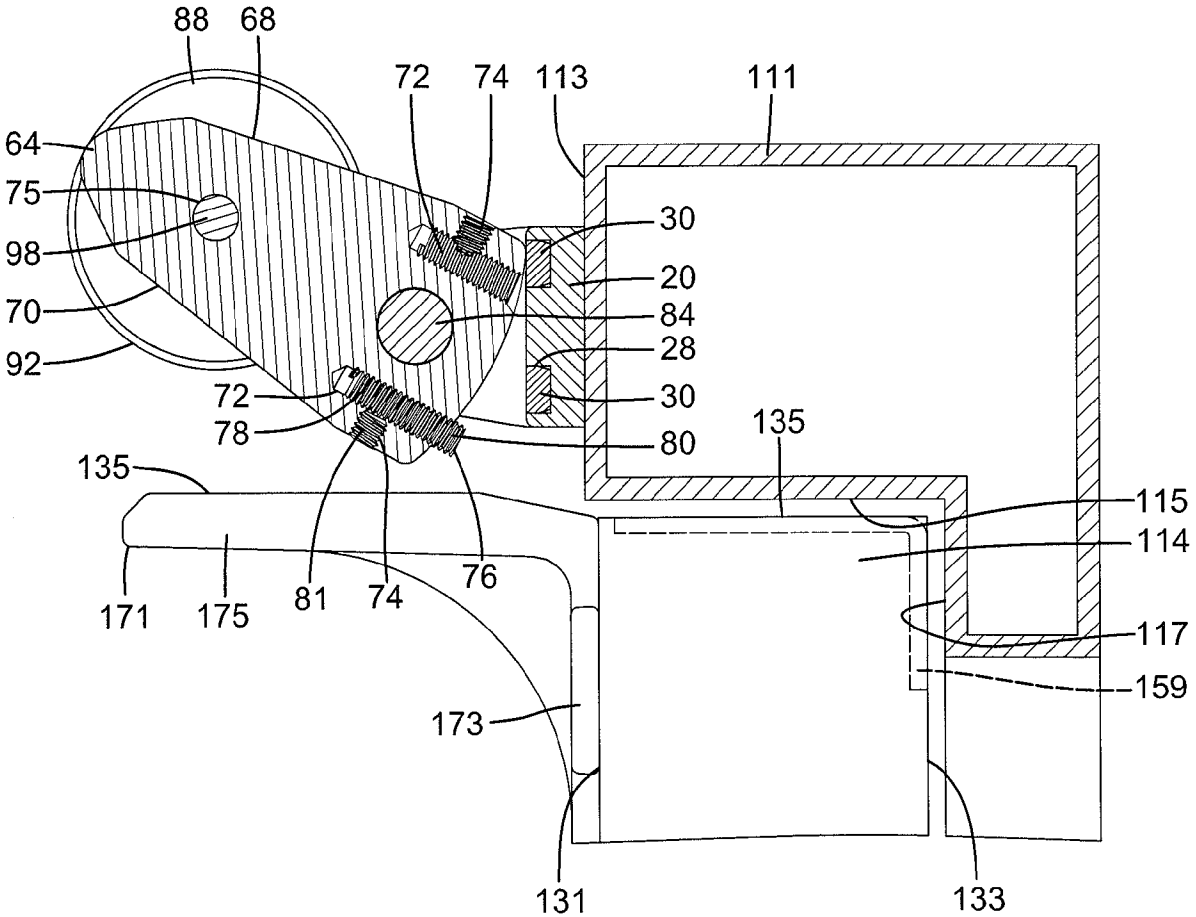
FIG. 11 is a view similar to FIG. 10, with the pivotal member pivoted to a position allowing easy access to the outer end of the pressing bolt.

When it is desired to adjust pressing bolt 76, bolt 81 is loosened, and pivotal member 32 is pivoted to a position in which first and second rams 44 and 62 extend upward (FIG. 11) such that a user can easily access outer end 80 of pressing bolt 76 and rotate pressing bolt 76.

Figure 12:
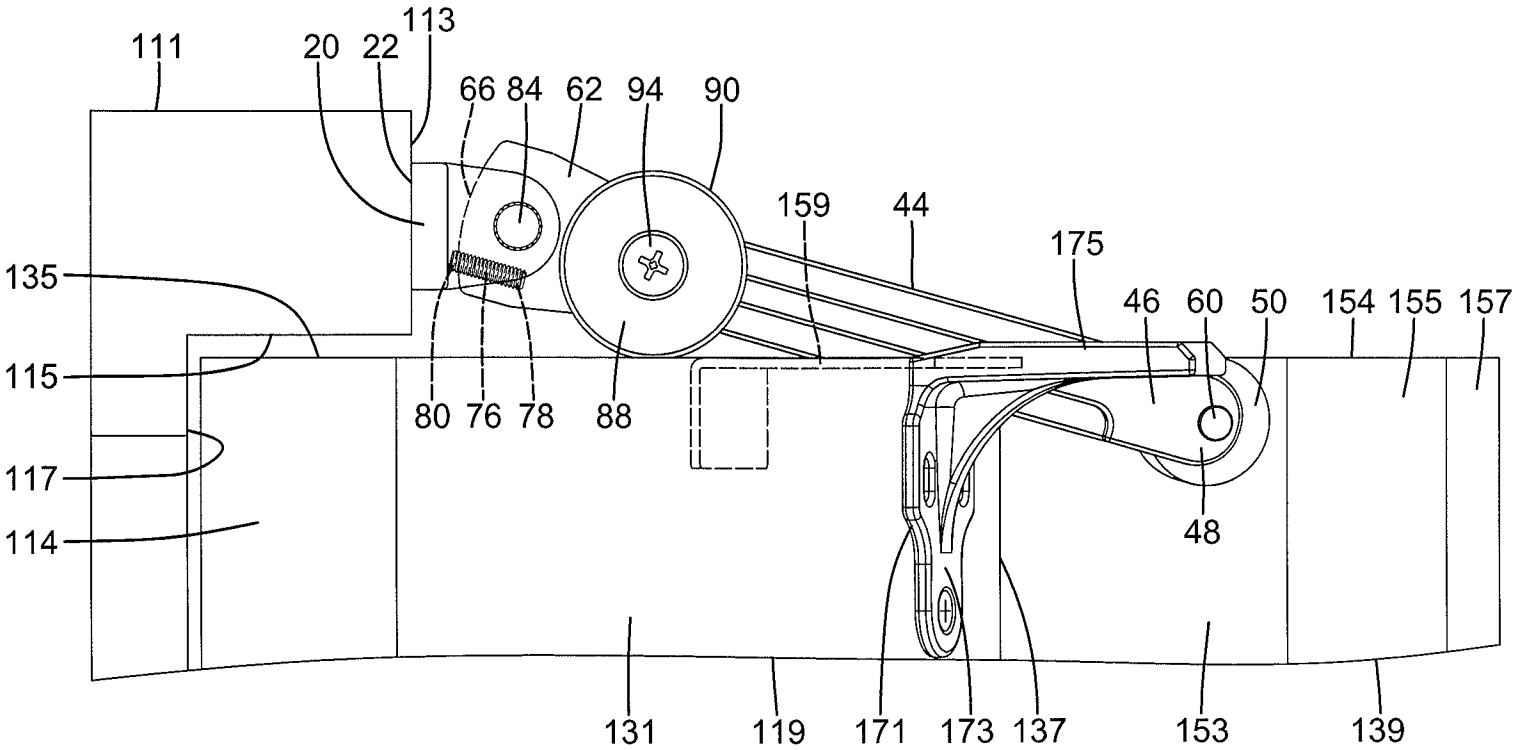
FIG. 12 is a view similar to FIG. 7, with the pressing bolt adjusted to increase the length of its exposed section in response to lower active and inactive doors so as to move the buffering wheel and a guiding wheel downward to match the lower active and inactive doors.

The blocking position of pivotal member 32 can be adjusted by changing the exposed length of pressing bolt 76 outside of lower screw hole 72 (namely, the position of outer end 80 of pressing bolt 76) in response to the locations of top side 135 of inactive door 119 and top surface 154 of active door 139. Specifically, if the exposed length of pressing bolt 76 is reduced, the height of guiding wheel 88 and the height of buffering wheel 50 in the vertical direction relative to the longitudinal axis of axle 34 are lowered. On the other hand, if the exposed length of pressing bolt 76 is increased, the height of guiding wheel 88 and the height of buffering wheel 50 in the vertical direction relative to the longitudinal axis of axle 34 are increased. Note that top side 135 of inactive door 119 and top surface 154 of active door 139 in FIG. 12 are respectively lower than top side 135 of inactive door 119 and top surface 154 of active door 139 in FIG. 7. In response to this change, pressing bolt 76 is rotated to reduce the exposed length of pressing bolt 76 for lowering guiding wheel 88 and buffering wheel 50 in the vertical direction. Thus, top side 135 of inactive door 119 is located between pivot 94 and the lowest point of outer periphery 92 of guiding wheel 88 after adjustment. Furthermore, buffering wheel 50 is below top surface 154 of active door 139. Thus, when inactive door 119 pivots from its non-closing position to the closing position, pivotal member 32 can be pivoted from the blocking position to the non-blocking position, and buffering wheel 50 can stop active door 139 from pivoting to the closing position while pivotal member 32 is in the blocking position.

Pressing bolt 76 can be engaged with upper screw hole 72 of second arm 62 if door coordinator 10 is mounted to a door that is opened in an opposite direction. Regardless of mounting of pressing bolt 76 in either of upper and lower screw holes 72, outer end 80 of pressing bolt 76 presses against one of abrasion resistant member 30.

By using door coordinator 10 to control the sequential closing of inactive and active doors 119 and 139, active door 139 will be closed after inactive door 119 is closed even if inactive and active doors 119 and 139 are simultaneously pivoted from the non-closing positions to the closing positions.

Soft portion 54 of buffering wheel 50 can absorb the impact while active door 139 presses against buffering wheel 50, and rigid portion 52 reduces the deformation in the outer periphery of soft portion 54, maintaining the roundness of buffering wheel 50 and avoiding permanent deformation of soft portion 54 and allowing buffering wheel 50 to smoothly roll on second surface 153 of active door 139 without hindering movement of pivotal member 32 from the blocking position to the non-blocking position.

By providing abrasion resistant members 30 on base 20, outer end 80 of pressing bolt 76 presses against one of abrasion resistant members 30 when pivotal member 32 is in the blocking position, avoiding base 20 from wear. The blocking position of pivotal member 32 will not be changed without adjustment of pressing bolt 76, assuring that inactive door 119 can push pivotal member 32 from the blocking position to the non-blocking position.

Since pressing bolt 76 is mounted on second arm 62 of pivotal member 32, after door coordinator 10 is mounted to door frame 111. Then, the user can merely pivot pivotal member 32 to a position in which first and second arms 44 and 62 extend upward, the user can rotate outer end 80 of pressing bolt 76 exposed outside of lower screw hole 72, easily adjusting the exposed length of pressing bolt 76 in response to the heights of inactive and active doors 119 and 139.

Now that the basic teachings of the present invention have been explained, many extensions and variations will be obvious to one having ordinary skill in the art. For example, pivotal member 32 can include only one of upper and lower screw holes 72 and only one of top and bottom screw holes 74, and base 20 can include only one insertion groove 28 receiving only one abrasion resistant member 30.

Thus since the invention disclosed herein may be embodied in other specific forms without departing from the spirit or general characteristics thereof, some of which forms have been indicated, the embodiments described herein are to be considered in all respects illustrative and not restrictive. The scope of the invention is to be indicated by the appended claims, rather than by the foregoing description, and all changes which come within the meaning and range of equivalency of the claims are intended to be embraced therein.

The invention claimed is:

1. A door coordinator comprising:

a base (20) including an outer face (24), with an insertion groove (28) formed in the outer face (24) of the base (20), with the base (20) adapted to be fixed to a mounting face (113) of a door frame (111), with an inactive door (119) and an active door (139) adapted to be pivotably mounted to the door frame (111), with each of the inactive door (119) and the active door (139) adapted to be pivotable between a closing position and a non-closing position;

an abrasion resistant member (30) fixed in the insertion groove (28);

a pivotal member (32) including an axle (34) pivotably mounted to the base (20), with the axle (34) including first and second ends (36, 38) spaced from each other along a longitudinal axis of the axle (34) perpendicular to a vertical direction, with a first arm (44) extending from the first end (36) of the axle (34) in a radial direction perpendicular to the longitudinal axis of the axle and having a distal end (46), with a second arm (62) formed on the second end (38) of the axle (34) and having a length in the radial direction smaller than a length the first arm (44) in the radial direction, with the second arm (62) including front and rear ends (64, 66), with the front end (64) of the second arm (62) located between the axle (34) and the distal end (46) of the first arm (44), with a screw hole (72) formed in the rear end (66) of the second arm (62), with the pivotal member (32) pivotable relative to the base (20) between a blocking position and a non-blocking position;

a guiding wheel (88) pivotably mounted to the second arm (62), wherein when the pivotal member (32) is in the blocking position, the guiding wheel (88) is adapted to press against by a top side (135) of the inactive door (119), the top side (135) of the inactive door (119) actuates the guiding wheel (88) when the inactive door (119) is moving from the non-closing position to the closing position, causing pivotal movement of the pivotal member (32) from the blocking position to the non-blocking position;

a buffering wheel (50) pivotably mounted to the distal end (46) of the first arm (44), wherein when the pivotal member (32) is in the blocking position, the buffering wheel (50) is adapted to block the active door (139) to prevent the active door (139) from moving from the non-closing position to the closing position, wherein when the pivotal member (32) is in the non-blocking position, the buffering wheel (50) is located above a top surface (154) of the active door (139), allowing the active door (139) to pivot from the non-closing position to the closing position; and a pressing bolt (76) threadedly and rotatably engaged in the screw hole (72) in the second arm (62), with the pressing bolt (76) including an inner end (78) received in the screw hole (72) and an outer end (80) outside of the screw hole (72), with the outer end (80) of the pressing blot (76) pressing against the abrasion resistant member (30) when the pivotal member (32) is in the blocking position, with the outer end (80) of the pressing bolt (76) spaced from the abrasion resistant member (30) when the pivotal member (3) is in the non-blocking position, with the pressing bolt (76) rotatable relative to the second arm (62) to adjust a length of an exposed section of the pressing bolt (76) outside of the screw hole (72), with the pivotal member (32) in the blocking position, a height of each of the buffering wheel (50) and the guiding wheel (88) in the vertical direction relative to longitudinal axis of the axle (34) is increased if the length of the exposed section of the pressing bolt (76) is increased, and the height of each of the buffering wheel (50) and the guiding wheel (88) in the vertical direction relative to the longitudinal axis is decreased if the length of the exposed section of the pressing bolt (76) is decreased.

2. The door coordinator as claimed in claim 1, with the first arm (44) including two ears (48) on the distal end (46), with the buffering wheel (50) including a rigid portion (52) and a soft portion (54) enveloping the rigid portion (52), with the rigid portion (52) being a roller rotatably mounted between the ears (48), with the soft portion (54) adapted to absorb impact from the active door (139) when the active door (139) pivots from the non-closing position to the closing position, with the rigid portion (52) adapted to avoid permanent deformation of the soft portion (54).

3. The door coordinator as claimed in claim 1, with the rigid portion (52) including two outer sides having a plurality of engagement holes (56), with the soft portion (54) made of a material, with plurality of engagement holes (56) filled with the material, avoiding the soft portion (54) from disengaging from the rigid portion (52).

* * * * *